US011918843B2

(12) United States Patent
Sorin

(10) Patent No.: US 11,918,843 B2
(45) Date of Patent: Mar. 5, 2024

(54) OFFSET J-HOOK APPARATUSES AND METHODS OF USE

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 0 days.

(21) Appl. No.: 17/243,964

(22) Filed: Apr. 29, 2021

(65) Prior Publication Data

US 2021/0339108 A1 Nov. 4, 2021

Related U.S. Application Data

(60) Provisional application No. 63/018,545, filed on May 1, 2020.

(51) Int. Cl.
*A63B 21/078* (2006.01)
*A47B 81/00* (2006.01)
*A63B 71/00* (2006.01)

(52) U.S. Cl.
CPC ..... *A63B 21/0783* (2015.10); *A47B 81/00* (2013.01); *A63B 71/0036* (2013.01)

(58) Field of Classification Search
CPC ..... A63B 71/0036; A63B 21/078; A63B 21/0783; A47B 81/00; A47F 5/0876
USPC ..... 211/106.01
See application file for complete search history.

(56) References Cited

U.S. PATENT DOCUMENTS 4,262,901 A * 4/1981 Faust ..... A63B 21/078 482/104
4,650,186 A * 3/1987 McCreery ..... A63B 21/4005 482/104
5,570,957 A * 11/1996 Kuly ..... A63B 23/00 384/42
5,727,764 A * 3/1998 Angeles ..... A47B 57/482 248/295.11
6,149,556 A * 11/2000 Jordan ..... A63B 71/0036 482/106
D444,827 S * 7/2001 Mobley ..... D21/694
6,746,379 B1 * 6/2004 Brawner ..... A63B 21/0783 482/112
D516,900 S * 3/2006 Hoernig ..... D8/367
D562,670 S * 2/2008 Rogers ..... D8/330
7,338,416 B2 * 3/2008 Smith ..... A63B 21/078 482/106
7,635,322 B2 * 12/2009 Parrilla ..... A63B 23/0405 482/94
7,699,756 B2 4/2010 Plane, Jr.
8,337,370 B2 * 12/2012 Rogers ..... A63B 71/0036 482/94
D697,388 S * 1/2014 Pan ..... D8/367
9,044,643 B2 * 6/2015 Staten ..... A63B 21/0783
9,216,314 B2 * 12/2015 Chen ..... A63B 21/072
9,289,638 B2 * 3/2016 Towley, III ..... A63B 21/00047
9,333,387 B2 * 5/2016 Hopperstad ..... A63B 21/00047
(Continued)

OTHER PUBLICATIONS https://www.fortisequipment.com/product/fortis-bar-holders/#prettyPhoto. Oct. 31, 2015.

*Primary Examiner* — Stanton L Krycinski
(74) *Attorney, Agent, or Firm* — Maynard Nexsen PC; Todd Allen Serbin

(57) ABSTRACT

A weight rack attachment apparatus, comprising: a front hook portion, where the hook is J-shaped; a rear connecting portion including a connecting pin along a centerline of the weight rack attachment apparatus, wherein the front hook portion is offset from the centerline.

11 Claims, 7 Drawing Sheets

(56) References Cited

U.S. PATENT DOCUMENTS

D761,638 S * 7/2016 Johnson ..... D8/367
9,597,539 B2 * 3/2017 Grider ..... A63B 21/00047
9,630,046 B2 4/2017 Childs
9,907,991 B2 3/2018 Leipheimer
D818,547 S * 5/2018 Meredith ..... D21/686
10,058,728 B2 * 8/2018 Kelly ..... A63B 21/078
10,086,226 B2 * 10/2018 Nelson ..... A63B 21/4035
10,307,634 B2 * 6/2019 Young ..... A63B 71/023
10,391,377 B1 * 8/2019 Sorin ..... A63B 22/0046
10,426,993 B2 * 10/2019 Ostmeyer ..... A63B 21/0783
D890,273 S * 7/2020 Dunahay ..... D8/372
10,792,535 B2 * 10/2020 Chou ..... A63B 1/00
D907,725 S * 1/2021 Adams ..... D21/694
10,953,301 B2 * 3/2021 Brasch ..... A63B 71/0036
D915,533 S * 4/2021 Adams ..... D21/694
10,967,217 B2 * 4/2021 Arroyo ..... A63B 21/0626
10,967,218 B2 * 4/2021 Murrell ..... A63B 17/00
10,974,091 B1 * 4/2021 Hensler ..... A63B 21/062
11,110,316 B2 * 9/2021 Sergakis ..... A63B 21/078
11,260,260 B2 * 3/2022 Hammond ..... A63B 71/0619
2004/0162200 A1 * 8/2004 Brawner ..... A63B 21/078
482/142
2007/0203003 A1 * 8/2007 Brawner ..... A63B 21/078
482/104
2008/0004165 A1 * 1/2008 Brawner ..... A63B 21/0783
482/104
2012/0289384 A1 * 11/2012 Staten ..... A63B 21/0783
482/104
2014/0200117 A1 * 7/2014 Grider ..... A63B 17/04
482/104
2015/0016919 A1 * 1/2015 Tambornino ..... F16B 35/06
411/366.1
2015/0083681 A1 * 3/2015 Childs ..... A47F 7/00
211/85.7
2015/0290488 A1 * 10/2015 Hopperstad ..... A63B 17/04
482/38
2017/0007877 A1 * 1/2017 Leipheimer ..... A63B 21/4029
2017/0065844 A1 3/2017 Hopperstad et al.
2017/0246490 A1 * 8/2017 Hopperstad ..... A63B 1/00
2017/0246496 A1 * 8/2017 Nelson ..... A63B 21/0724
2018/0104527 A1 * 4/2018 Meredith ..... A47B 81/00
2019/0247701 A1 * 8/2019 Sergakis ..... A63B 71/0036
2020/0114191 A1 * 4/2020 Chen ..... A63B 71/0036
2020/0222745 A1 * 7/2020 Leipheimer ..... A63B 21/4034
2020/0391070 A1 * 12/2020 Henniger ..... F16B 12/36
2021/0187342 A1 * 6/2021 Coulter ..... A63B 21/4029

* cited by examiner

OFFSET J-HOOK APPARATUSES AND METHODS OF USE

RELATED APPLICATION

This application claims the benefit of priority under 35 U.S.C. § 119(e) of U.S. Provisional Patent Application No. 63/018,545 filed May 1, 2020, the contents of which are incorporated herein by reference in their entirety.

FIELD OF THE INVENTION

The present invention, in some embodiments thereof, relates to the fitness industry and, more particularly, but not exclusively, to a weight rack attachment.

BACKGROUND OF THE INVENTION

J-hooks are currently used in the weight lifting industry for secure placement of weight lifting equipment, such as weight bars thereon. Typically, two corresponding J-hooks are placed on weight rack vertical components at corresponding heights to create a divided landing space for the weight bar. However, J-hooks currently available to the industry are configured along the centerline of the weight rack vertical components.

SUMMARY OF THE INVENTION

According to an aspect of some embodiments of the present invention there is provided a weight rack attachment apparatus, comprising: a front hook portion, where the hook is J-shaped; a rear connecting portion including a connecting pin along a centerline of the weight rack attachment apparatus, wherein the front hook portion is offset from the centerline.

In an embodiment of the invention, the apparatus further comprises a front plate.

In an embodiment of the invention, the apparatus further comprises a back plate.

In an embodiment of the invention, the apparatus further comprises a back extension.

In an embodiment of the invention, the apparatus further comprises a protective cover on the front hook portion.

In an embodiment of the invention, the apparatus further comprises a front plate and a back plate, wherein the distance between the front plate and the back plate is slightly larger than the width of a convention weight rack vertical component.

According to an aspect of some embodiments of the present invention there is further provided a kit of weight rack attachment apparatuses, comprising: a first J-hook apparatus including a front hook portion, where the hook is J-shaped, a rear connecting portion including a connecting pin along a centerline of the weight rack attachment apparatus, wherein the front hook portion is offset from the centerline; and, a second J-hook apparatus including a front hook portion, where the hook is J-shaped, a rear connecting portion including a connecting pin along a centerline of the weight rack attachment apparatus, wherein the front hook portion is offset from the centerline in a direction opposite from the front hook portion of the first J-hook apparatus.

According to an aspect of some embodiments of the present invention there is further provided a method of installing a weight rack attachment apparatus on a weight rack vertical component, comprising: inserting a connecting pin of the weight rack attachment apparatus into an attachment hole located on the weight rack vertical component, wherein the weight rack attachment apparatus is in a horizontal configuration; releasing the weight rack attachment apparatus; rotating the weight rack attachment apparatus around a central axis of the connecting pin; stopping the weight rack attachment apparatus with a back plate when the back plate comes to abut the weight rack vertical component.

In an embodiment of the invention, the method further comprises reversing the actions of stopping to inserting to remove the weight rack attachment apparatus from the weight rack vertical.

According to an aspect of some embodiments of the present invention there is further provided method of customizing the distance between two weight rack attachment apparatuses on two vertically parallel a weight rack vertical components, comprising: inserting a connecting pin of a first weight rack attachment apparatus into an attachment hole located on a first weight rack vertical component, wherein the first weight rack attachment apparatus is in a horizontal configuration; releasing the first weight rack attachment apparatus; rotating the first weight rack attachment apparatus around a central axis of the connecting pin; stopping the first weight rack attachment apparatus with a back plate when the back plate comes to abut the first weight rack vertical component; repeating the inserting to stopping using a second, mirror-image weight rack attachment apparatus on the second weight rack vertical component.

Additionally, alternatively and/or optionally, the method further comprises customizing to a different distance between two weight rack attachment apparatuses by switching the first weight rack attachment apparatus to the second weight rack vertical component and switching the second weight rack attachment apparatus to the first weigh rack vertical component.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
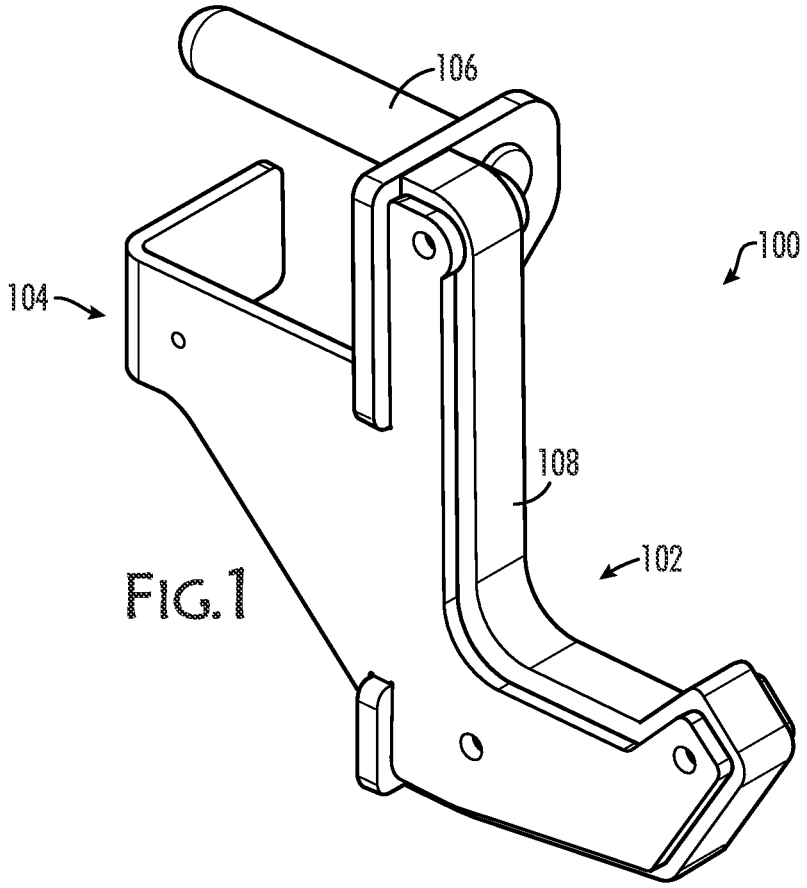
FIG. 1 is a top, front perspective view of an offset J-hook apparatus, in accordance with an exemplary embodiment of the invention.

The present invention, in some embodiments thereof, relates to the fitness industry and, more particularly, but not exclusively, to a weight rack attachment.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Generally, what is described herein is a J-hook weight rack attachment which is different than what is conventionally offered and known in the industry because of its modified, off-center arrangement. Such an off-center or offset configuration provides a number of advantages over a conventional, center aligned J-hook, as will be described herein.

For the purposes of this application, "front" means the side of the J-hook apparatus which is closest to a user facing a weight rack on which the J-hook is mounted. "Back" or "rear" is the side of the J-hook opposite the front. The "left" side refers to the user's left from the perspective of the user facing the weight rack and "right" is the side opposite the left. "Up" or "top" and "down" and "bottom" are also with respect to the perspective of the user facing the weight rack.

Referring now to the drawings, FIG. 1 is a top, front perspective view of an offset J-hook apparatus 100, in accordance with an exemplary embodiment of the invention. The J-hook apparatus is provided with a front hook portion 102 and a rear connecting portion 104, wherein the front hook portion 102 is adapted for placement of weight lifting instruments, such as a weight bar, thereon by being substantially J-shaped and wherein the rear connecting portion 104 is adapted to mount or attach the J-hook apparatus 100 to a weight rack (shown and described in more detail with respect to FIGS. 4, 5, and 11). As described in more detail below, a connecting pin 106 is attached to an upper portion of the J-hook apparatus 100, wherein the connecting pin 106 is sized and shaped for insertion into and through an attachment hole 402 (shown in more detail in FIG. 4) on a weight rack. In some embodiments of the invention, the front hook portion 102 is provided with some form of protective cover 108 or protective surface for enduring repeated impacts from the placement of weight lifting equipment thereon.

Figure 2:
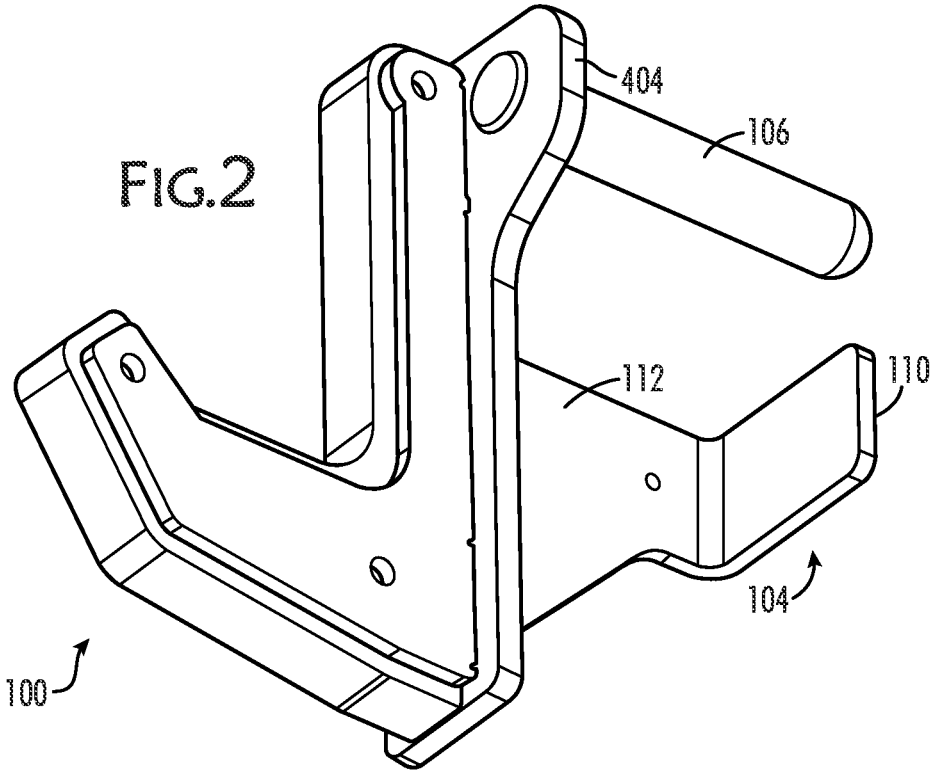
FIG. 2 is a bottom, front perspective view of an offset J-hook apparatus, in accordance with an exemplary embodiment of the invention.
Figure 4:
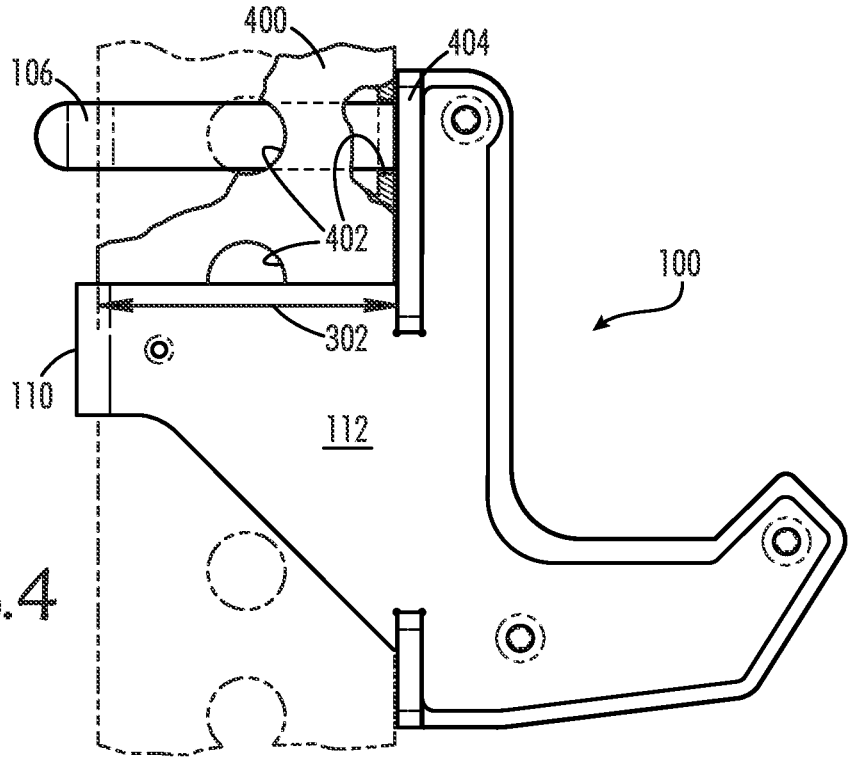
FIG. 4 is a left side view of an offset J-hook apparatus, in accordance with an exemplary embodiment of the invention.
Figure 5:
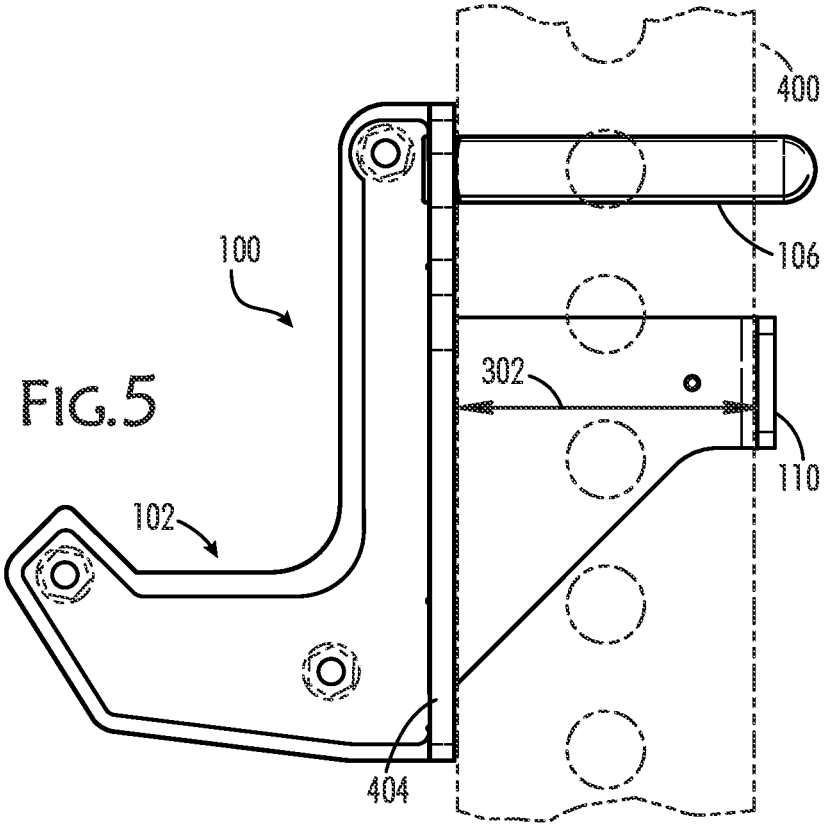
FIG. 5 is a right side view of an offset J-hook apparatus, in accordance with an exemplary embodiment of the invention.

FIG. 2 is a bottom, front perspective view of an offset J-hook apparatus 100, in accordance with an exemplary embodiment of the invention. As can be seen in FIG. 2, the rear connecting portion 104 includes a back plate 110 and a back extension 112, in an embodiment of the invention. It should be understood that the back plate 110 intended to rest flush with a back side of a weight rack vertical component 400 (such as shown in FIGS. 4 and 5) and the back extension is sized with a length such that the distance 302 between a front plate 404 of the front hook portion 102 and the back plate 110 is almost the exact same width as the weight rack vertical component 400 so that the J-hook apparatus 100, when attached to the weight rack, is stably mounted thereon because of the tight fit between the weight rack vertical component being hemmed in by the front plate 404 and the back plate 110. In some embodiments of the invention, at least one of the back plate 110 and the back extension 112 are provided with a protective cover of some sort, for example a rubber or polymer piece, to protect the weight rack from the repeated impacts caused by attaching the J-hook apparatus 100 to the weight rack vertical component 400.

Figure 3:
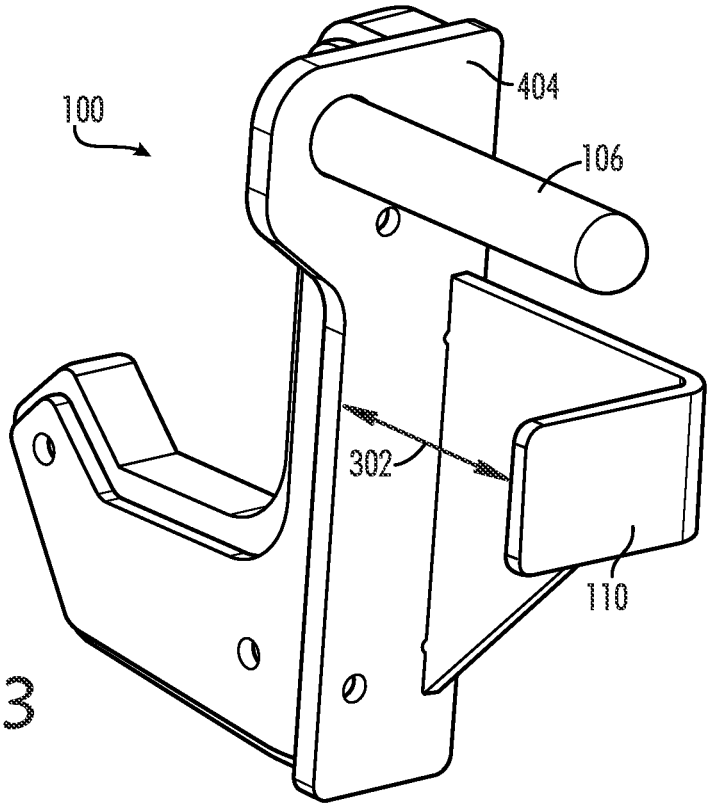
FIG. 3 is a rear perspective view of an offset J-hook apparatus, in accordance with an exemplary embodiment of the invention.

FIG. 3 is a rear perspective view of an offset J-hook apparatus 100, in accordance with an exemplary embodiment of the invention. The distance 302 between the front plate 404 and the back plate 110 is clearly demonstrated by FIG. 3.

FIG. 4 is a left side view of an offset J-hook apparatus 100, in accordance with an exemplary embodiment of the invention. FIG. 4 also shows how the J-hook apparatus 100 is disposed on a weight rack vertical component 400 when properly installed. In an embodiment of the invention, the connecting pin 106 is inserted through an attachment hole 402 which is located on a front side of the weight rack vertical component 400. In addition, the vertical weight rack component 400 is "trapped" between the front plate 404 and the back plate 110 with minimal tolerances such that the J-hook apparatus 100 does not substantially move or rock during placement or removal of weight equipment from the front hook portion 102. From FIG. 4, it can be seen that distance 302 is just slightly greater than the width of the weigh rack vertical component 400.

FIG. 5 is a right side view of an offset J-hook apparatus 100 on the weight rack vertical component 400, in accordance with an exemplary embodiment of the invention.

Figure 6:
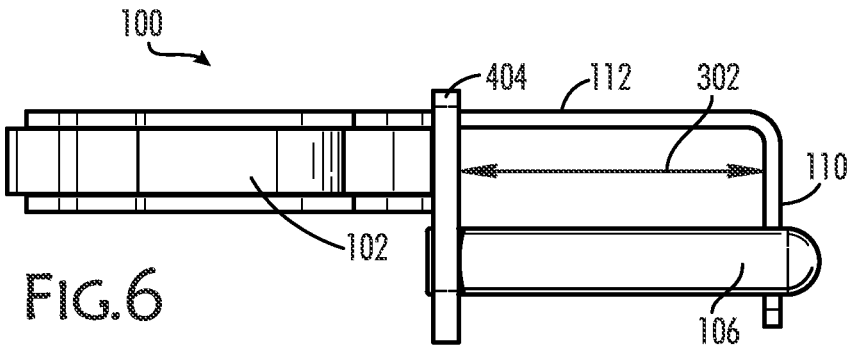
FIG. 6 is a top view of an offset J-hook apparatus, in accordance with an exemplary embodiment of the invention.
Figure 7:
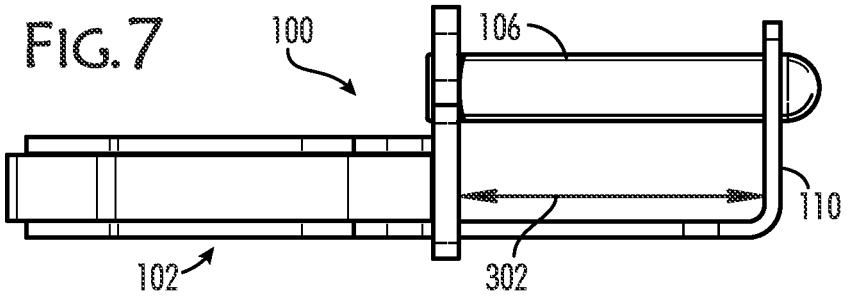
FIG. 7 is a bottom view of an offset J-hook apparatus, in accordance with an exemplary embodiment of the invention.

FIG. 6 is a top view of an offset J-hook apparatus 100, in accordance with an exemplary embodiment of the invention and FIG. 7 is a bottom view of an offset J-hook apparatus 100, in accordance with an exemplary embodiment of the invention.

Figure 8:
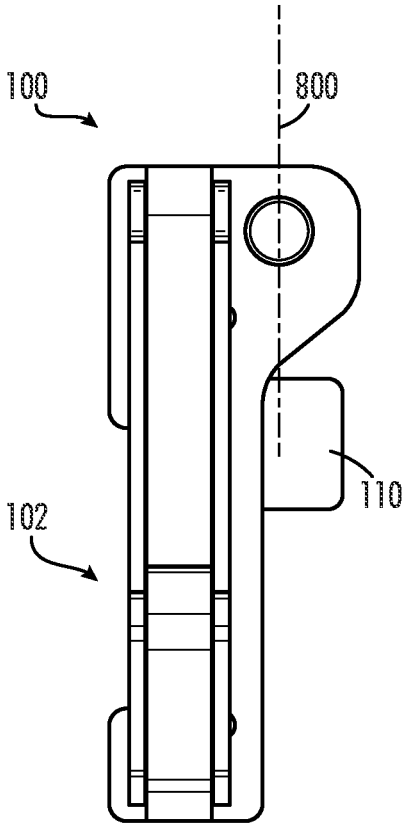
FIG. 8 is a front view of an offset J-hook apparatus, in accordance with an exemplary embodiment of the invention.

FIG. 8 is a front view of an offset J-hook apparatus 100, in accordance with an exemplary embodiment of the invention, which shows generally a centerline 800 of the apparatus 100 which passes through the center of the circular cross-section of the connecting pin 106. The centerline 800 of the apparatus 100 corresponds to the centerline of the weight rack vertical component 400, as can be seen in FIG.

Figure 9:
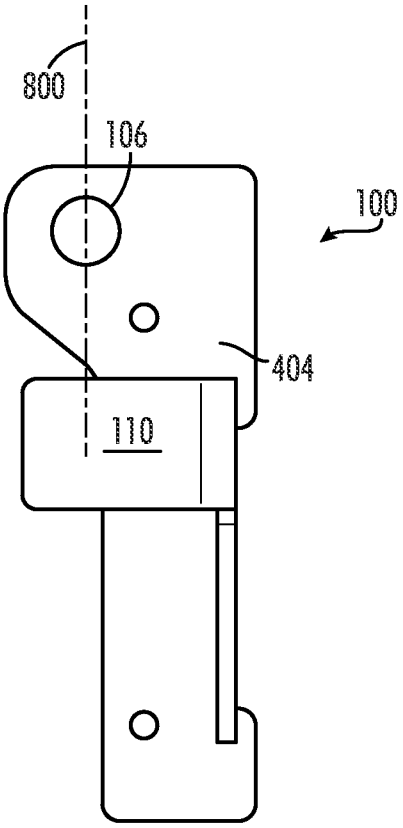
FIG. 9 is a rear view of an offset J-hook apparatus, in accordance with an exemplary embodiment of the invention.

11. FIG. 9 is a rear view of the offset J-hook apparatus 100, in accordance with an exemplary embodiment of the invention.

Figure 10:
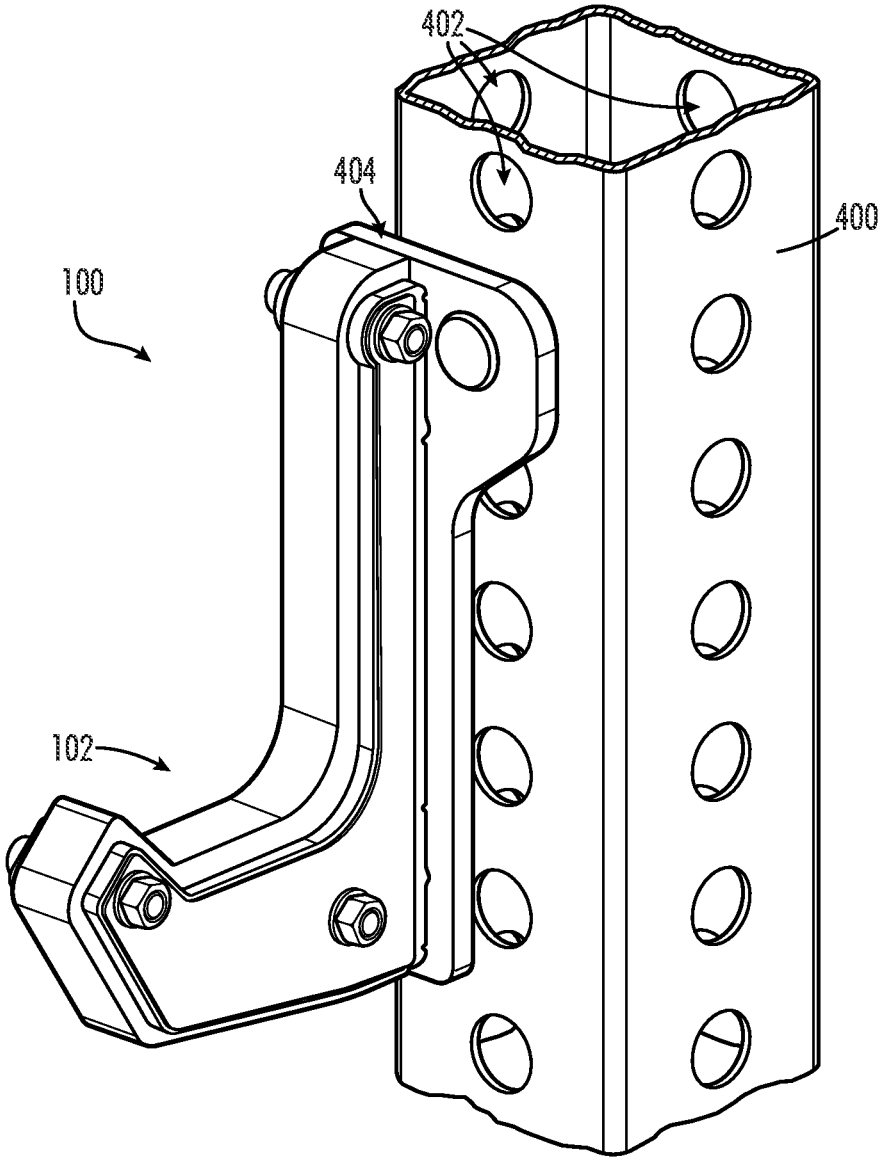
FIG. 10 is a perspective view of an offset J-hook apparatus on a weight rack, in accordance with an exemplary embodiment of the invention.

FIG. 10 is a perspective view of an offset J-hook apparatus 100 installed on the weight rack vertical 400, in accordance with an exemplary embodiment of the invention. As seen in FIG. 10, it can be seen that the front hook portion 102 is not aligned along the centerline of the weight rack vertical component 400, which is an unconventional configuration, but yet is still capable of being mounted on a conventionally arranged weight rack with attachment holes 402 running down the centerline. Currently, only J-hooks which are configured to lie along the centerline are available.

It should be noted, and as will be more readily apparent in FIG. 11, that by offsetting the J-hook portion 102 of the apparatus 100, the distance between two J-hook apparatuses on two parallel weight rack vertical components can be adjusted simply by putting two mirror-image offset J-hook apparatuses on the weight rack vertical components (as described in more detail below). It should also be noted, that while there is an advantage to being able alter the space between the J-hooks, it also means that there must be two different J-hook apparatuses, whereas with conventional J-hooks a user can have two identical pieces, which would be considered a feature of the conventional J-hook that the current J-hook apparatuses eschew.

Figure 11:
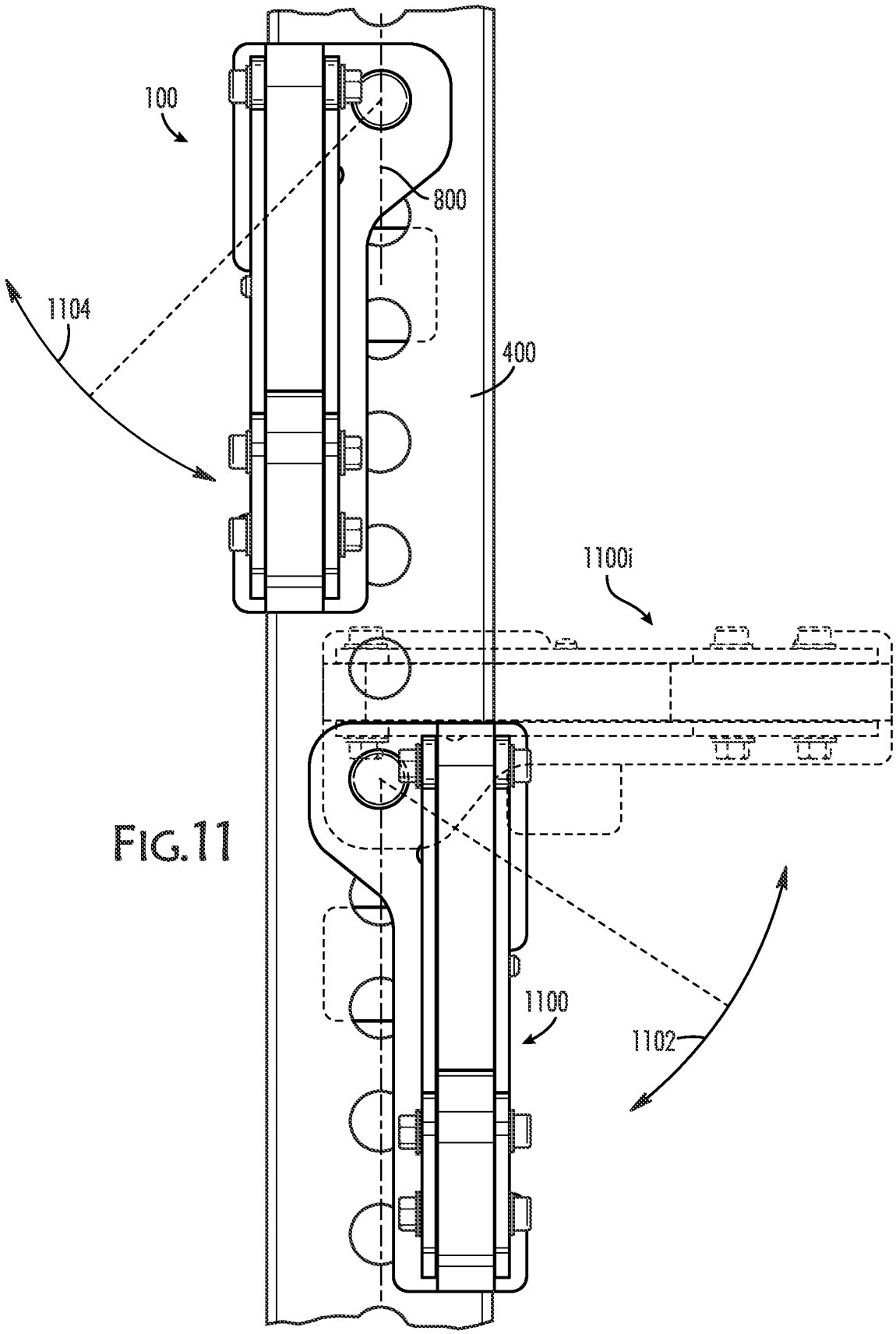
FIG. 11 is a front view of two offset J-hook apparatuses being attached/detached from a weight rack, in accordance with an exemplary of the invention; and, FIG. 12 is a flowchart of a method of attaching or detaching an offset J-hook apparatus to/from a weight rack, in accordance with an exemplary of the invention.

FIG. 11 is a front view of two mirror-image offset J-hook apparatuses 100, 1100 being attached/detached from the same weight rack vertical component 400, in accordance with an exemplary of the invention, although it should be understood that in typical use, offset J-hook apparatus 100 and mirror-image offset J-hook apparatus 1100 would be located at the same height (in the same corresponding attachment hole 402 on each component) on vertically parallel weight rack vertical components, such as in a conventional weight rack configuration like the Sorinex® Base Camp™ rack. Mirror-image, offset J-hook apparatus 1100 is similar to J-hook apparatus 100, except that the majority of the apparatus 1100 extends in an opposite direction from the centerline of the weight rack vertical component 400. In this way, the distance between the two J-hook apparatuses 100, 1100 can be increased or decreased merely by switching which weight rack vertical component they are mounted on. That is, in some embodiments, the J-hook apparatuses 100, 1100 are mounted so that their respective front hook portions 102 are farther apart than the conventional J-hook pair, but if the J-hook apparatuses 100, 1100 are switched, the front hook portions 102 would be closer together than the conventional J-hook pair. This is not merely a frivolous change in the J-hook apparatuses because by being able to modify the distance between the hooks, more users of different sizes can use them. That is, larger users can more comfortably and securely lift weights with a weight bar because the hooks are father apart, whereas smaller users can flip the offset J-hooks and weight lift more comfortably and securely because the hooks are closer together. As mentioned, being able to control the distance between the J-hook apparatuses 100, 1100 also enhances user safety since for certain users, conventional J-hooks may be too far apart for easy placement of a weight bar thereon (a smaller user might have to reach, with heavy weight, which isn't good), or vice versa, may be too close together for easy placement of a weight bar thereon (a larger user might get jammed in and not be able to properly maneuver the weight bar onto the J-hook).

Figure 12:
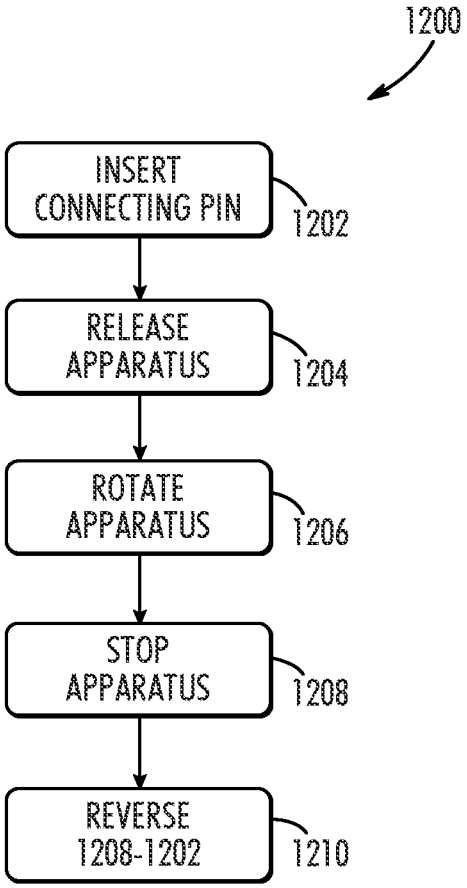

FIG. 12 is a flowchart 1200 of a method of attaching or detaching an offset J-hook apparatus 100 to/from a weight rack, in accordance with an exemplary of the invention. Reference is also made to FIG. 11 in conjunction with the flowchart of FIG. 12. In an embodiment of the invention, the rear connecting portion 104 of the J-hook apparatus 100 is open on one side (the side opposite the back extension 112, which "closes" that side) so that the J-hook apparatus 100 can be removably attached to and detached from the weight rack vertical component 400. FIG. 11 shows the mirror-image J-hook apparatus **1100*i* in a horizontal orientation wherein the back plate 110 and the back extension 112 are not in a position to abut the weight rack vertical component 400. This installation configuration is initiated by inserting (1202) the connecting pin 106 into an attachment hole 402 located on the weight rack vertical component, wherein the J-hook apparatus is in the horizontal orientation shown by imaginary apparatus 1100*i*. The J-hook apparatus 1100 is then released (1204) to enable downward rotation (1206) about a central axis of the connecting pin 106 whereby the J-hook apparatus 1100 is then stopped (1208) in a vertical configuration by the vertically oriented back extension 112 when the back extension 112 hits the weight rack vertical component 400 (such as shown in FIGS. 4, 5 10 and 11). It should be understood that two mirror-image offset J-hook apparatuses 100, 1100 rotation is counter-clockwise 1104 and clockwise 1102, respectively to transition from horizontal to vertical, due to their mirror-image configurations. In an embodiment of the invention, to remove (1210**) a J-hook apparatus, the steps are essentially reversed.

It is expected that during the life of a patent maturing from this application many relevant J-hooks will be developed and the scope of the term J-hook is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A weight rack attachment apparatus, comprising:

a front hook portion comprising a complete hook-shaped structure configured for placement of weight lifting instruments thereon, where the hook portion is J-shaped;

a rear connecting portion including a connecting pin along a centerline of the weight rack attachment apparatus, wherein the front hook portion is offset from the centerline and disposed directly in front of the rear connecting portion.

2. The weight rack attachment apparatus according to claim 1, further comprising a front plate.

3. The weight rack attachment apparatus according to claim 1, further comprising a back plate.

4. The weight rack attachment apparatus according to claim 3, further comprising a back extension.

5. The weight rack attachment apparatus according to claim 1, further comprising a protective cover on the front hook portion.

6. The weight rack attachment apparatus according to claim 1, further comprising a front plate and a back plate, wherein the distance between the front plate and the back plate is slightly larger than the width of a weight rack vertical component.

7. A kit of weight rack attachment apparatuses, comprising:

a first J-hook apparatus including a front hook portion comprising a complete hook-shaped structure configured for placement of weight lifting instruments thereon, where the hook portion is J-shaped, a rear connecting portion including a connecting pin along a centerline of the first J-hook apparatus, wherein the front hook portion is offset from the centerline and disposed directly in front of the rear connecting portion; and, a second J-hook apparatus including a front hook portion, where the hook portion is J-shaped, a rear connecting portion including a connecting pin along a centerline of the second J-hook apparatus, wherein the front hook portion is offset from the centerline and disposed directly in front of the rear connecting portion in a direction opposite from the front hook portion of the first J-hook apparatus.

8. A method of installing a weight rack attachment apparatus on a weight rack vertical component, comprising:

inserting a connecting pin of the weight rack attachment apparatus into an attachment hole located on the weight rack vertical component, wherein the weight rack attachment apparatus is in a horizontal configuration;

releasing the weight rack attachment apparatus;

rotating the weight rack attachment apparatus around a central axis of the connecting pin;

stopping the weight rack attachment apparatus with a back plate when the back plate comes to abut the weight rack vertical component wherein a front hook portion of the weight rack attachment apparatus comprising a complete hook-shaped structure configured for placement of weight lifting instruments thereon is offset from a centerline of the weight rack attachment apparatus such that upon stopping, the front hook portion is offset from a centerline of the weight rack vertical component and disposed directly in front of a rear connecting portion.

9. The method of claim 8, further comprising reversing the actions of stopping to inserting to remove the weight rack attachment apparatus from the weight rack vertical component.

10. A method of customizing the distance between two weight rack attachment apparatuses on two vertically parallel weight rack vertical components, comprising:

inserting a connecting pin of a first weight rack attachment apparatus into an attachment hole located on a first weight rack vertical component, wherein the first weight rack attachment apparatus is in a horizontal configuration;

releasing the first weight rack attachment apparatus;

rotating the first weight rack attachment apparatus around a central axis of the connecting pin;

stopping the first weight rack attachment apparatus with a back plate when the back plate comes to abut the first weight rack vertical component;

repeating the inserting to stopping using a second, mirror-image weight rack attachment apparatus on a second weight rack vertical component, wherein a front hook portion of the first and second weight rack attachment apparatuses comprising a complete hook-shaped structure configured for placement of weight lifting instruments thereon is offset from a centerline of the respective weight rack attachment apparatuses such that upon stopping, the front hook portion of the first and second weight rack attachment apparatuses is offset from a centerline of the respective weight rack vertical components and wherein the front hook portions are disposed directly in front of rear connecting portions disposed on each of the first and second weight rack attachment apparatuses, respectively.

11. A method according to claim 10, further comprising customizing to a different distance between two weight rack attachment apparatuses by switching the first weight rack attachment apparatus to the second weight rack vertical component and switching the second weight rack attachment apparatus to the first weigh rack vertical component.

* * * * *